United States Patent [19]

Kirchweger et al.

[11] 4,183,344

[45] Jan. 15, 1980

[54] LOW-NOISE LEVEL INTERNAL COMBUSTION ENGINES

[75] Inventors: Karl Kirchweger; Gerhard Thien; Heinz Fachbach, all of Graz, Austria

[73] Assignee: Hans List, Graz, Austria

[21] Appl. No.: 962,115

[22] Filed: Nov. 20, 1978

[30] Foreign Application Priority Data

Nov. 23, 1977 [AT] Austria ..... 8414/77

[51] Int. Cl.[2] ..... F02B 77/00

[52] U.S. Cl. ..... 123/198 E; 123/195 A; 123/195 C; 181/204

[58] Field of Search ..... 123/198 E, 195 A, 195 C, 123/195 S, 41.7; 181/204

[56] References Cited

U.S. PATENT DOCUMENTS

| | | | |
|---|---|---|---|
| 3,534,828 | 10/1970 | Tuer | 123/198 E |
| 3,949,727 | 4/1976 | Thien et al. | 123/198 E |
| 4,071,009 | 1/1978 | Kraina | 123/198 E |
| 4,149,512 | 4/1979 | Hatz | 123/198 E |

*Primary Examiner*—Ira S. Lazarus

*Attorney, Agent, or Firm*—Watson, Cole, Grindle & Watson

[57] ABSTRACT

An internal combustion engine comprises an engine unit support and a crankcase which parts are connected by a resonance-absorbing element. The engine parts located above the resonance-absorbing element are encased by a noise-suppressing encapsulation. The exhaust pipe and the inlet pipe penetrate the encapsulation without touching it and are connected to the cylinderhead by vibration-insulating couplings. Supporting arms are provided which support the exhaust and the inlet pipes. The supporting arms are secured to the crankcase which is freed from body resonance due to the resonance-absorbing element. The supporting arms take over all holding and vibration forces so that the vibration-insulating couplings may be designed very soft in the sense of optimal vibration insulation.

5 Claims, 1 Drawing Figure

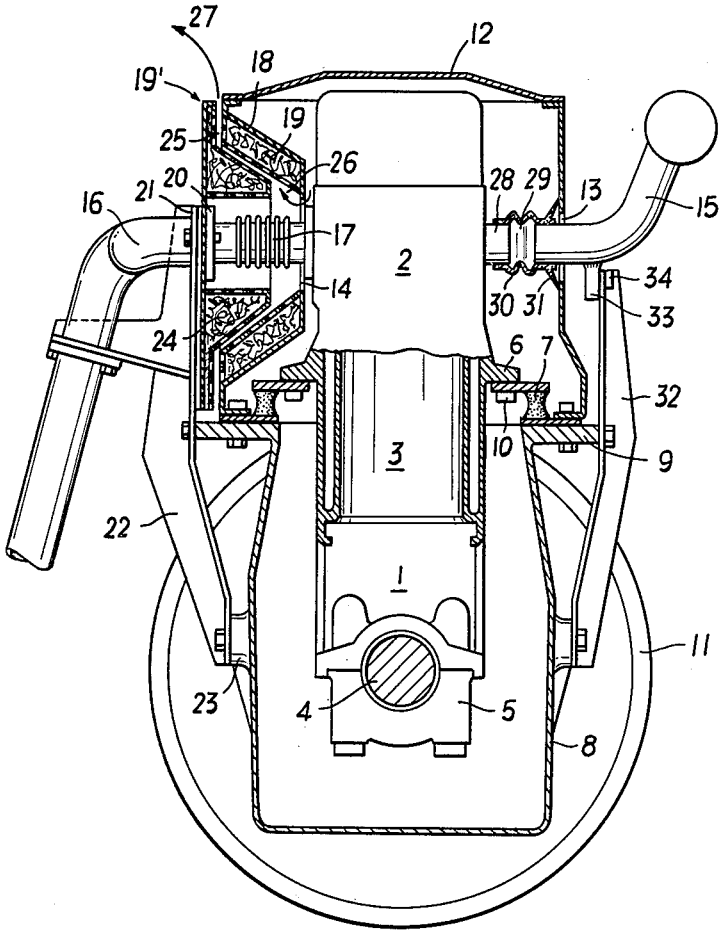
27
12
18
19'
19
25
26
28
29
13
15
16
21
20
17
2
14
34
30
31
33
24
6
7
32
10
9
3
22
1
11
23
4
5
8

LOW-NOISE LEVEL INTERNAL COMBUSTION ENGINES

BACKGROUND OF THE INVENTION

This invention relates to an internal combustion engine comprising an engine unit support, cylinder, cylinderhead, and auxiliary units connected to the cylinder or to the cylinderhead. These engine parts are directly affected by body resonance and sound vibration. The engine comprises further a crankcase, a flywheel case, and at least one resonance-absorbing element which connects the engine unit support to the crankcase and flywheel case, and a noise-suppressing encapsulation secured to the crankcase and the flywheel case and encasing the engine parts which are directly affected by body resonance and sound vibration.

DESCRIPTION OF THE PRIOR ART

In internal combustion engines having a noise-suppressing encapsulation the design of the connection of the exhaust and the inlet pipes and of the point of penetration of the pipes through the noise-suppressing encapsulation is a difficult problem. On the one hand contact of the exhaust and inlet pipes, which are affected by body resonance, must be avoided to prevent body resonance or heat of the exhaust pipe from being transmitted to the noise-suppressing encapsulation. On the other hand connection of the exhaust and inlet pipes to the engine must be made such that transmission of body resonance via the exhaust and inlet pipes is obviated.

As a solution of this problem it is known to connect the exhaust pipe and the inlet pipe, respectively, to the cylinderhead by interposed vibration-insulating couplings. The pipe or the couplings penetrate the encapsulation without touching it and the penetration apertures are acoustically sealed by absorption silencers surrounding the pipes or couplings, respectively, to prevent air-transmitted noise from escaping the encapsulation. In this known embodiment the vibration-insulating couplings had to accomplish also a certain supporting function for the adjoining pipes and therefore such couplings were relatively hard.

This known solution was sufficient for engines encapsulated in conventional manner by a complete encapsulation, because with such conventional encapsulations improvements below a certain degree of noise reduction can not be obtained. So the relatively small amount of body resonance transmitted from the encapsulation by the hard vibration-insulating couplings made no important difference.

In low-noise-level internal combustion engines of the kind referred to at the beginning a method for noise reduction was realized which enables an especially efficient reduction of noise emission. However, with such constructions also noise sources, which till now in conventionally encapsulated engines could be neglected, must be taken into consideration. Therefore, for instance, also the couplings for connecting the exhaust and inlet pipes to the cylinderhead or the location of the couplings have to be optimized with regard to minimal noise emission. This is an object of the present invention.

SUMMARY OF THE INVENTION

The present invention consists in that the exhaust pipe and the inlet pipe penetrate the encapsulation without touching it and are connected to the cylinderhead by means of vibration-insulating couplings and that the parts of the exhaust pipe and the inlet pipe located outside the encapsulation are each supported by supporting means which is secured to the crankcase freed from vibration by the resonance-absorbing element. This construction enables to utilize very soft vibration-insulating couplings because they have to overtake no supporting forces at all. Also more liberty with regard to the selection and design of the couplings is obtained so that, for instance, vibration effects can be obviated easier than till now. This results in a significantly longer life of the vibration-insulating couplings without acoustical drawbacks. The supporting means is secured to the crankcase which is freed from body resonance by the resonance-absorbing element between the engine unit support and the crankcase, and therefore the supporting means do not radiate noise. Furthermore with the embodiment according to the invention more freedom with regard to the laying of the exhaust pipe line in the vehicle is obtained because vibrations and forces emanating from the pipe end are absorbed by the supporting means and kept away from the soft vibration-insulating coupling.

According to a further embodiment of the invention, the vibration-insulating coupling of the exhaust pipe is located outside the encapsulation and surrounded by a bipartite absorption silencer, the outer part of which, the connecting flanges of the vibration-insulating coupling, and the exhaust pipe outside the encapsulation are secured to the supporting means, the inner part of the absorption silencer is attached to a recess of the encapsulation with a narrow roof-like gap being formed between the two parts of the silencer. By this design not only a very heat-resistant and durable connection of the exhaust pipe is obtained, but also a very favourable sound-absorption behaviour. The design of the silencer is such that advantageously only little construction space is needed. Due to the separation of the outer part of the silencer from the encapsulation no undue heat transmission from the exhaust pipe to the encapsulation occurs. The special design of the inner part of the silencer and the roof-like gap between the two silencer parts prevents undesired entry of air heated on the hot vibration-insulating coupling into the inside of the encapsulation.

According to a further embodiment of the invention the cylinderhead is provided with tube-like sleeves on the inlet side and the inlet pipe is arranged leaving a distance to the sleeves inside the encapsulation, said distance being bridged in a sealing manner by an elastic member as the vibration-insulating coupling. This ensures a very effective body resonance insulation with very simple means and simple assembling facility. Furthermore it is very advantageous when the elastic member is a rubber sleeve. An especially simple and efficient construction is further obtained when the elastic member is provided with an annular sealing lip on the end directed to the encapsulation, which rests against the encapsulation wall. By these simple means a satisfactory insulation of body resonance and air-transmitted noise is simultaneously ensured.

DESCRIPTION OF THE DRAWING

The invention will be hereinafter more specifically explained with reference to an exemplary embodiment depicted in the accompanying drawing showing an internal combustion engine according to the invention schematically in cross section.

DESCRIPTION OF THE PREFERRED EMBODIMENT

The internal combustion engine comprises an engine unit support 1 which contains the power-leading engine structure, mainly a cylinderhead 2, a cylinder 3, a crankshaft 4, crankshaft main bearings 5, and (not shown) auxiliary units secured to the cylinderhead 2. These engine parts are directly affected by body resonance and sound vibration. The engine unit support 1 is connected to a crankcase 8 by a resonance-absorbing element 7 which is secured to a flange 6 provided on the engine unit support and a corresponding flange 9 provided on the crankcase 8 by screws 10. The crankcase 8 is cast integral with a flywheel case 11. The engine parts above the resonance-absorbing element 7 are encased by a noise-suppressing encapsulation 12 secured to the crankcase 8 and the flywheel case 11. The encapsulation 12 is provided with apertures 13,14 to enable penetration of an inlet pipe 15 and of a vibration-insulating coupling 17 which connects an exhaust pipe 16 to the cylinderhead 2. In the region of the coupling 17 the encapsulation is provided with a roof-like recess 18 extending nearly to the cylinderhead. In the recess 18 there is located the inner part 19 of an absorption silencer 19'. The exhaust pipe 16 is connected to the vibration-insulating coupling 17 by flanges 20,21. On the connecting point also a supporting arm 22 supporting the exhaust pipe 16 and the coupling 17 is screwed. The supporting arm 22 is secured to the flange 9 of the crankcase 8 and to a bunch 23 provided on the crankcase 8 which is free from body resonance due to the provision of the resonance-absorbing element 7. On the flanges 20,21 also the outer part 24 of the absorption silencer 19' is attached.

The outer part 24 of the absorption silencer 19' has a roof-like shape and extends into the corresponding roof-like recess 18 of the encapsulation 12 thereby leaving a roof-like gap 25 between the inner part 19 and the outer part 24 of the silencer. During engine operation a part of the encapsulation cooling air drawn from a not shown blower escapes through the aperture 14 and the gap 25 to the surrounding atmosphere, as indicated by arrows 26,27, thereby cooling the vibration-insulating coupling 17. After stopping the engine, air heated by the hot coupling 17 may emerge also through the gap 25 due to a chimney draft effect, and undesired re-entry of hot air into the encapsulation is prevented.

On the inlet side of the engine tube-like sleeves 28 are arranged at the inlet ports which preferably are pressed into the ports. The inlet pipe 15 is arranged with an axial distance 29 to the sleeve 28 which is bridged by a rubber sleeve 30. The rubber sleeve 30 is provided with a sealing lip 31 which rests against the encapsulation 12 and prevents air-transmitted noise from escaping the encapsulation through the aperture 13. The inlet pipe 15 is connected by a bunch 33 and a screw 34 to a supporting arm 32 which is secured to the crankcase 8.

We claim:

1. An internal combustion engine comprising an engine unit support, cylinder, cylinderhead and auxiliary units connected to the cylinder or to the cylinderhead, said engine parts being directly affected by body resonance and sound vibration, further comprising a crankcase, a flywheel case, and at least one resonance-absorbing element which connects said engine unit support to said crankcase and said flywheel case, and a noise-suppressing encapsulation secured to the crankcase and the flywheel case and encasing said engine parts which are directly affected by body resonance and sound vibration, wherein an exhaust pipe and an inlet pipe penetrate said encapsulation without touching it and are connected to the cylinderhead by means of vibration-insulating couplings, the parts of the exhaust pipe and the inlet pipe located outside the encapsulation each being supported by supporting means which is secured to the crankcase freed from vibration by said resonance-absorbing element.

2. An internal combustion engine according to claim 1 wherein the vibration-insulating coupling of the exhaust pipe is located outside the encapsulation and surrounded by a bipartite absorption silencer, the outer part of which, the connecting flanges of the vibration-insulating coupling, and the exhaust pipe outside the encapsulation being secured to the supporting means, the inner part of the absorption silencer being attached to a recess of the encapsulation with a narrow roof-like gap being formed between the two parts of the silencer.

3. An internal combustion engine according to claim 1 wherein the cylinderhead is provided with tube-like sleeves on the inlet side and the inlet pipe is arranged leaving a distance to said sleeves inside the encapsulation, said distance being bridged in a sealing manner by an elastic member as the vibration insulating coupling.

4. An internal combustion engine according to claim 3 wherein the elastic member is a rubber sleeve.

5. An internal combustion engine according to claim 3 wherein the elastic member is provided with an annular sealing lip on the end directed to the encapsulation, which rests against the encapsulation wall.

* * * * *